US005230606A

United States Patent [19]

Chin-Fu

[11] Patent Number: 5,230,606

[45] Date of Patent: Jul. 27, 1993

[54] ELECTRIC FAN WITH HOT AIR/COLD AIR DUAL-MODE CONTROL

[76] Inventor: Ke Chin-Fu, Fl. 2, No. 29, Lane 255, Min-Chyuan St., Yeong Ho City, Taipei Hsien, Taiwan

[21] Appl. No.: 935,285

[22] Filed: Aug. 26, 1992

[51] Int. Cl.[5] ..... B64C 11/02

[52] U.S. Cl. ..... 416/39; 392/362

[58] Field of Search ..... 416/5, 39, 95, 100; 392/362, 361

[56] References Cited

U.S. PATENT DOCUMENTS

| | | | |
|---|---|---|---|
| 449,404 | 3/1891 | Dewey | 392/362 |
| 676,949 | 6/1901 | Hawkins | 392/362 |
| 684,459 | 10/1901 | Porter | 392/362 |
| 1,784,528 | 12/1930 | Lidke et al. | 392/362 |
| 2,110,621 | 3/1938 | Cohen | 392/362 |
| 3,109,913 | 11/1963 | Galajda | 416/39 |

FOREIGN PATENT DOCUMENTS

| | | | |
|---|---|---|---|
| 2172935 | 10/1986 | United Kingdom | 392/362 |

*Primary Examiner*—Edward K. Look
*Assistant Examiner*—Mark Sgantzos

[57] ABSTRACT

An electric fan includes a vane assembly fastened to a hub connected to a base plate in front of a motor output shaft of the motor by a connector and two bearings, which vane assembly is consisted of a plurality of vanes, of which each is comprised of an electric heating element covered by two aluminum alloy blades with radiating fins thereon and electrically connected to the two opposite ends of an external power supply through a switch with an adjustable thermostat in series to control the "on" or "off" and the temperature of the heating elements.

2 Claims, 3 Drawing Sheets

ELECTRIC FAN WITH HOT AIR/COLD AIR DUAL-MODE CONTROL

BACKGROUND OF THE INVENTION

The present invention relates to electric fans and relates more particularly to an electric fan which can be controlled to produce a current of cold air for cooling the people or a current of hot air for warming a room.

An electric fan is generally consists of a series of vanes radiating from a hub rotated on its axle by a motor to produce a current of cold air for cooling the people. Therefore, an electric fan is useful only in hot days. During the coldest season, an electric heater or hot air conditioner may be used for warming a room. An air conditioner is expensive and consumes more electric power. An electric heater is less expensive, however, it does not induce a circulation of air for warming a broad room space.

SUMMARY OF THE INVENTION

The present invention has been accomplished under the aforesaid circumstances. It is therefore the main object of the present invention to provide an electric fan which can be controlled to alternatively produce a current of hot air for warming or a current of cold air for cooling. According to the preferred embodiment of the present invention, an electric fan is generally comprised of a base plate fastened to a motor housing in front of a motor, two bearings sleeved on the motor shaft of the motor and received inside a socket on the base plate, a vane assembly fastened to a hub coupled to the motor shaft by a connector. The vane assembly is consisted of a plurality of vanes, of which each is comprised of an electric heating element covered with two aluminum alloy blades and electrically connected to the two opposite ends of an external power supply through a control switch with an adjustable thermostat, which aluminum alloy blades have each a plurality of arched radiating fins on the outside. Rotating the motor causes the vane assembly to produce a current of hot air as the thermoswitch is switched on, or to produce a current of cold air as the thermoswitch is switched off.

DETAILED DESCRIPTION OF THE PREFERRED EMBODIMENT

Figure 1:
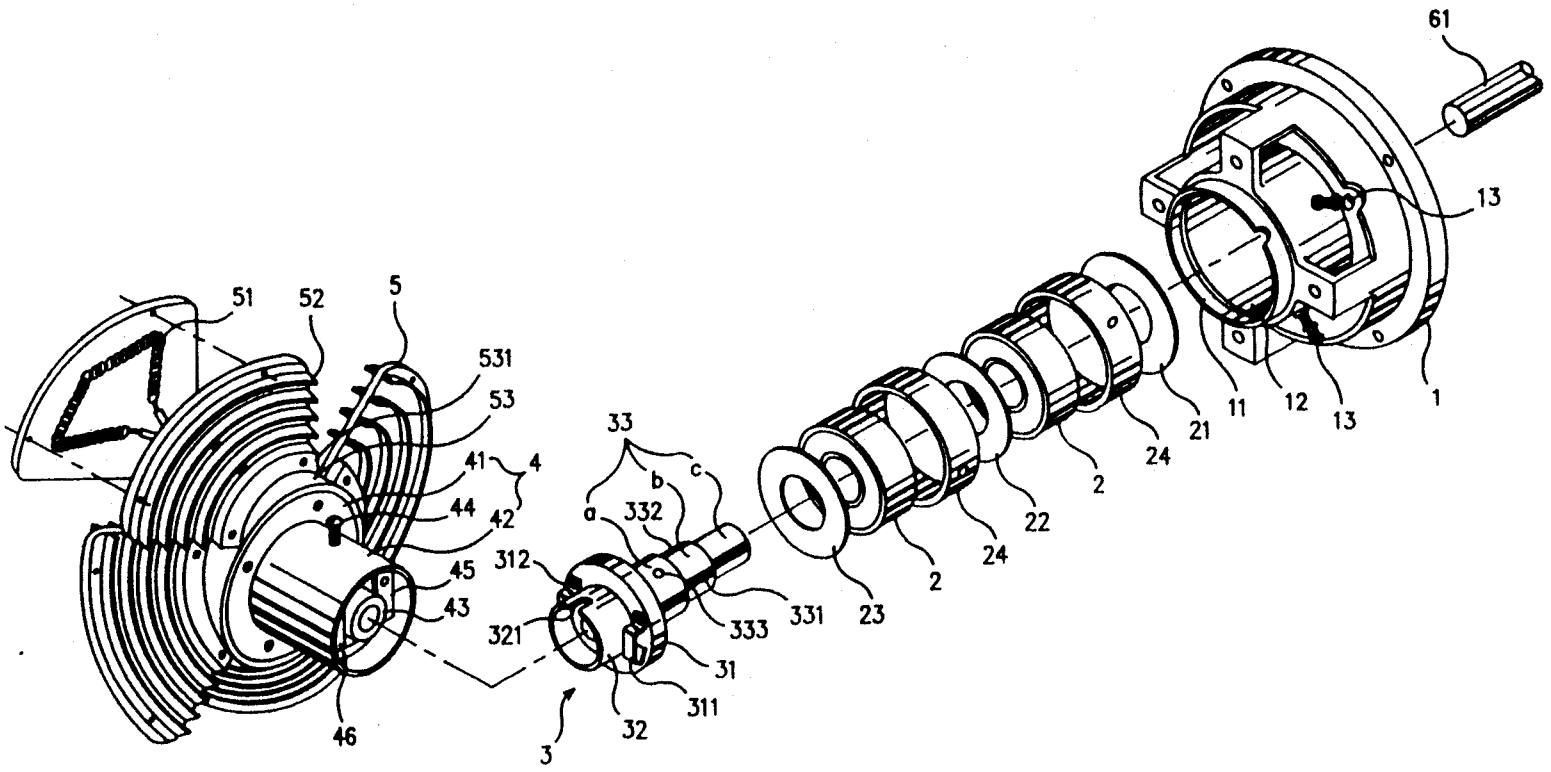
FIG. 1 is an exploded view of the preferred embodiment of the present invention.
Figure 2:
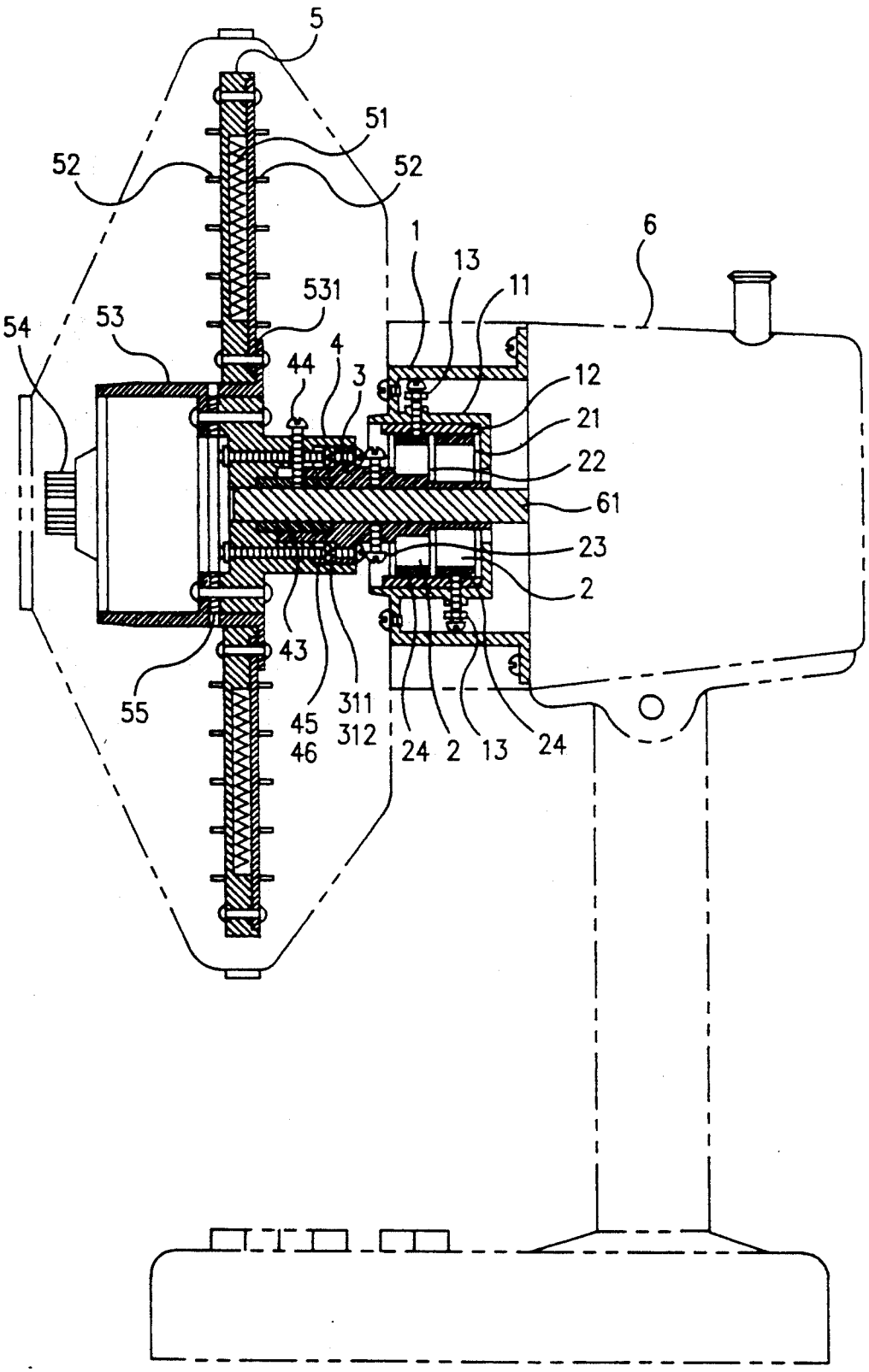
FIG. 2 is a sectional assembly view thereof.
Figure 3:
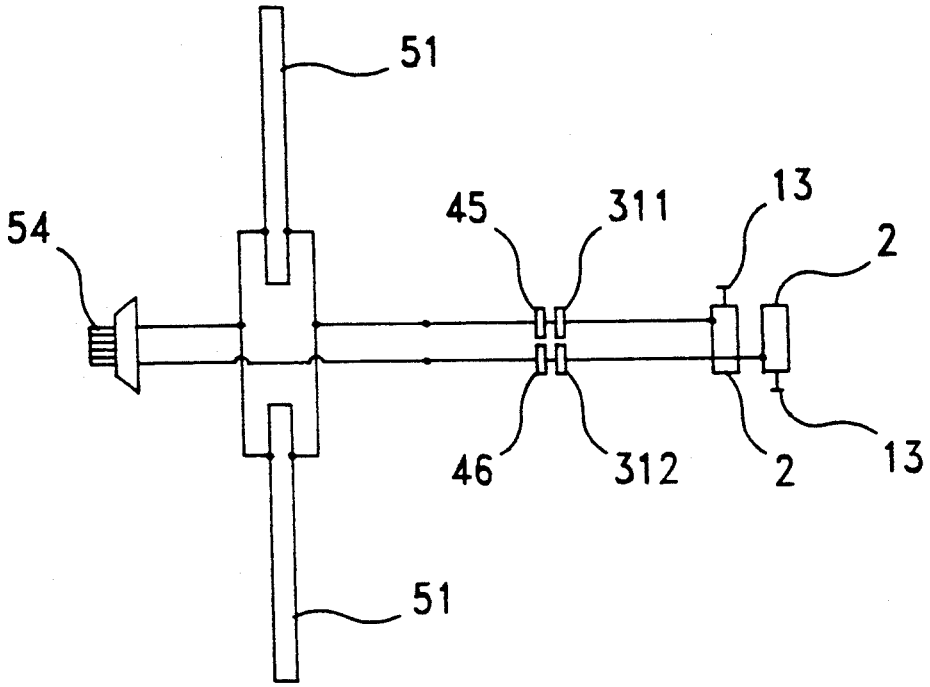
FIG. 3 is a circuit block diagram according to the present invention.

Referring to FIGS. 1, 2 and 3, an electric fan as constructed in accordance with the present invention is generally comprised of a base plate 1, two bearings 2, a connector 3, a connector receptacle 4, and a series of vanes 5. The base plate 1 comprises a socket 11, an insulating bushing 12 fitted into the socket 11, positive and negative power supply terminals 13 inserted through the socket 11 and the insulating bushing 12 at spaced locations. The bearings 2 are equal in outer diameter but different in inner diameter. The connector 3 is made from a plastic material through the process of injection molding, comprising a front tube 32 and a rear tube 33 separated by a collar 31. The rear tube 33 of the connector 3 is a stepped tube comprised of three sections 33*a*, 33*b*, 33*c* longitudinally aligned in proper order. The three sections 33*a*, 33*b*, 33*c* of the rear tube 33 are different in outer diameter, wherein the front section 33*a* > the intermediate section 33*b* > the rear section 33*c*. The rear tube 33 of the connector 3 has two conductive leaves 331,332 on surface thereof at two opposite locations, wherein one conductive leaf 331 extends from the front end of the front section 33*a* to the rear end of the rear section 33*c*; the other conductive leaf 332 extends from the front end of the front section 33*a* to the rear end of the intermediate section 33*b*. The collar 31 of the connector has two spring contacts 311,312 on the front side thereof respectively connected to the two conductive leaves 331,332. Furthermore, the front section 33*a* of the rear tube 33 has a bolt hole 333 through the wall thereof; the front tube 32 has a notch 321 on the front end edge thereof. The connector receptacle 4 is made from a plastic material through the process of injection molding, comprised of an outward flange 41 projected around a tubular casing 42. A reinforcing aluminum tube 43 is fastened inside the tubular casing 42 by a screw 44. The tubular casing 42 of the connector receptacle 4 has two electric contacts 45,46 on the inside at two opposite locations. The series of vanes 5 are each comprised of two aluminum alloy blades attached together with a respective electric heating element 51 fastened on the inside. The two opposite sides of each of the series of vanes 5 are fastened with a plurality of arched radiating fins 52 at right angles. The series of vanes 5 are fastened to an outward flange 531 on an aluminum alloy hub 53. The two opposite ends of the electric heating element 51 of each of the series of vanes 5 are respectively connected to the two contacts 45,46 on the tubular casing 42 of the connector receptacle 4. A switch 54 with an adjustable thermostat is mounted on the front end of the aluminum alloy hub 53 for controlling the electric connection between the contacts 45, 46, and limiting the temperature in a predetermined degree.

During the assembly process, the base plate is fastened in front of the motor 6 (see FIG. 2), the bearings 2 are fastened inside the socket 11 of the base plate 1, separated by insulating washers 21,22,23, and tightened up by two copper packing rings 24. The rear tube 33 of the connector 3 is inserted into the bearings 2 and coupled to the motor shaft 61 of the motor 6 by threading a tightening up screw (not shown) into the bolt hole 333 on the front section 33*a* of the rear tube 33. The outward flange 41 of the connector receptacle 4 is attached with and insulating element 55 and fastened inside the aluminum alloy hub 53, and therefore the series of vanes 5 are connected to the connector 3 by the aluminum alloy hub 53. The front tube 32 of the connector 3 is inserted into the tubular casing 42 of the connector receptacle 4. The screw 44 which fastens the reinforcing aluminum tube 43 to the tubular casing 42 of the connector receptacle 4 is threaded into the notch 321 on the front tube 32 of the connector 3. Therefore, the spring contacts 311, 312 are respectively connected to the electric contacts 45, 46, and the conductive leaves 331, 332 are respectively connected to the bearings 2, which are respectively connected to the positive and negative power supply terminals 13 through the copper packing rings 24. As the thermoswitch 54 was switched on and set at a predetermined temperature, the electric heating elements 51 in the series of vanes 5 are electrically connected to heat the series of vanes 5 and the radiating fins 52. Therefore, a flow of hot air is produced as the motor 6 is turned on. When the motor 6 is turned on as the switch 54 was switched off, the series of vanes 5 will be rotated to produce a flow of cold air for cooling the people.

Furthermore, a low revolving speed control knob may be provided for rotating the motor 6 at a low revolving speed as the switch 54 was switched on to electrically connect the electric heating elements 51 in heating the series of vanes 5 and the radiating fins 52.

What is claimed is:

1. An electric fan comprising:

a base plate fastened to a housing in front of a motor, said base plate having a front socket, two bearing inserted into an insulating bushing and tightened up by two copper packing rings respectively, said two bearings having each an axle hole and two opposite ends insulated by insulating washers, said two copper packing rings being respectively connected to positive and negative terminals of an external power supply;

a connector comprising a front tube and a stepped rear tube separated by a collar, said stepped rear tube being inserted through said respective axle hole on said two bearings and coupled to the output shaft of said motor and having two conductive leaves respectively connected to said external power supply through said two bearings and said copper packing rings, said collar having two spring contacts on a front face thereof respectively connected to said two conductive leaves;

a connector receptacle comprised of a tubular casing, which receives the front tube of said connector, said tubular casing having an outward flange projected around an outside wall thereof, a reinforcing aluminum tube on the inside inserted into the front tube of said connector, and two electric contacts respectively connected to the two spring contacts on the collar of said connector;

a vane assembly comprised of a series of vanes fastened around a hub secured to the outward flange of said connector receptacle, said vanes being each comprised of an electric heating element covered with two aluminum alloy blades, said electric heating element of each vane being respectively connected to two electric contacts on the tubular casing of said connector receptacle, said aluminum alloy blades having each a plurality of arched radiating fins on the outside at right angles;

a control switch with an adjustable thermostat controlled to electrically connect said positive and negative terminals of the external power supply in series with said heating elements causing said electric heating element of each vane to heat said radiating fins as said motor is turned on to rotate said vane assembly through said two bearings and said connector, so as to produce a current of hot air for a predetermined room temperature.

2. The electric fan of claim 1 wherein said two bearings each have an axle hole with a in different inner diameter to respectively fit in the two stepped sections of said rear stepped tube of said connector to make sure that said two bearings are fully isolated, and to be used as two terminals for conducting the electric power to said heating elements.

* * * * *